US005473833A

United States Patent [19]

Ostrovsky

[11] Patent Number: 5,473,833

[45] Date of Patent: Dec. 12, 1995

[54] CLIP-ON PRICE TICKET CHANNEL COVER FOR METAL SHELVING

[76] Inventor: John Ostrovsky, 47, Houseman Cr., Richmond Hill Ont., Canada, L4C 7R9

[21] Appl. No.: 273,705

[22] Filed: Jul. 12, 1994

[51] Int. Cl.[6] ..... G09F 3/20

[52] U.S. Cl. ..... 40/642; 40/5

[58] Field of Search ..... 40/642, 661, 5; 248/444.1, 221.3, 291

[56] References Cited

U.S. PATENT DOCUMENTS 5,263,269 11/1993 Tjärnlund ..... 40/5

FOREIGN PATENT DOCUMENTS 429400 5/1991 European Pat. Off. ..... 40/642
511468 11/1992 European Pat. Off. ..... 40/642
3513199 10/1986 Germany ..... 40/642
439940 12/1967 Switzerland ..... 40/642
WO92/20056 11/1992 WIPO ..... 40/642

*Primary Examiner*—Brian K. Green
*Assistant Examiner*—Joanne Silbermann
*Attorney, Agent, or Firm*—Adrian Zahl

[57] ABSTRACT

A clip-on label holder and cover is provided for insertion in a price ticket channel member of a shelf. The cover comprises an elongate clear plastic strip, having a clear plastic display panel and an integral clip. A label, such as a data strip, may be inserted between the panel and the channel member. The panel is biased towards the channel, to grip the card between the panel and the channel member. The clip is comprised of a generally hook-shaped member, when seen in cross-section, that comprises the lower edge of the cover. The clip defines an interior region, within which a lip of the channel member may be snap-fitted. The clip is provided with first and second shoulders to grip opposing sides of the channel member, to bias the panel towards the channel.

5 Claims, 2 Drawing Sheets

CLIP-ON PRICE TICKET CHANNEL COVER FOR METAL SHELVING

FIELD OF THE INVENTION

The present invention relates to a clear panel for attachment to the price ticket channel of a metal shelf, for use in a retail store display. The panel serves as a cover for a price ticket or other display gripped between the panel and the metal shelf.

BACKGROUND OF THE INVENTION

Where metal shelving is used to display goods in retail stores, it is usually required to provide a means for displaying price and other information relating to the products on display. Traditionally, this has been accomplished by providing labels that attach to a flat outside edge of the shelf by means of double-sided tape. However, such labels are difficult to remove and their removal leaves behind a sticky deposit on the shelf; this is particularly a problem in grocery stores, where price and product information changes very frequently. Accordingly, it has been recognized that it is desirable to provide a means whereby labels are removably retained for display at the shelf edge. In order to address this problem, shelves have been provided with a c-shaped channel along their exposed outer edge, referred to as a price ticket channel. Typical store shelves provided with such a channel include the Ontario Store Fixtures (tm.) shelf. This shelf is provided with a sheet metal c-channel formed from an extension of the upper surface of the shelf, bent to form a channel and spot-welded to the exposed outer edge of the shelf. The Hussmann (tm.) shelf is provided with an extruded aluminum channel member mounted to the edge of the shelf.

Where a channel is provided, a card or label may be retained directly within the channel. However, this approach leaves the labels open to switching or other tampering by customers. As well, it requires the use of labels made of a relatively rigid material, in order to achieve a firm retention within the channel. This requirement is expensive and may be incompatible with the computer-generated labelling system in use in many stores. Accordingly, it is desirable to place the labels behind a cover, to render it more difficult to tamper with the labels and allow for the use of paper labels. As well, it is desirable to provide a system that allows other forms of displays to be easily fixed to the shelf.

Various systems have been proposed to provide a clear covering or holder for labels to eliminate the need to tape labels directly to shelves and still protect the labels from tampering. The simplest of these is a simple plastic panel that is removably inserted into the c-channel, typically by sliding the panel into the channel from its end. A drawback of this approach is the difficulty and awkwardness of installing and removing the panels without disturbing the labels, whether to change the labels or to replace the panel when it becomes damaged. An alternative system is intended for use with flat-edged shelves. This approach is to provide a display holder that comprises a resilient clear plastic panel co-extruded with a flat backing panel. The backing panel may be taped to the flat edge of a shelf with double-sided tape. The respective panels are joined along their lower edges and are urged together by the resiliency of the plastic at the junction. Labels are sandwiched between the backing panel and the clear panel, and may be replaced by retracting the clear panel away from the backing panel. This solution suffers the disadvantage that when the holder becomes damaged, it may be difficult to remove it from the double-sided tape, and the old tape may leave behind a deposit. As well, initial installation may be time-consuming as a result of the use of double-sided tape. As well, the provision of backing and panel members requires two layers of plastic, with a corresponding increase in costs and resource use over the use of a single layer of plastic.

Accordingly, it is desirable to provide a holder to retain labels to a shelf, where the holder comprises a single layer of plastic and is not required to be taped to the shelf.

A holder or covering for labels faces several requirements. It must be simple to manufacture, install, and replace. Replacement of the labels must be simple and rapid. It should be relatively tamper-proof. Since the holder typically comprises an elongate strip that extends the length of the shelf and holds many labels, it should firmly hold each label independently of its neighbors. It should allow for the insertion of a variety of types of displays in addition to standard data strips, for example displays that extend outwardly from the holder. The data strip should be readable by a bar code scanner when held in the holder.

OBJECTS OF THE INVENTION

An object of the present invention is to provide a data strip or label holder that may be readily snap-fitted into the price ticket channel of a metal shelf, that is capable of releasably retaining a paper label. The invention is intended to provide a holder that is relatively simple to manufacture, install, replace, and use, and that securely holds a label between the holder and the shelf channel.

SUMMARY OF THE INVENTION

The present invention comprises a cover adapted to be engaged to a ticket display channel of a metal shelf. The metal shelf, which does not comprise a part of the invention, includes a channel having a generally vertically-oriented face plate that comprises the floor of the channel, and a lip extending outwardly along a longitudinal edge of the channel. The cover is adapted to grippingly retain a non-adhesive label, data strip, display card or the like between the cover and the floor of the channel. The cover comprises an elongate clear plastic strip, having a clear plastic display panel and an integral clip. A label, such as a data strip, may be inserted between the panel and channel member. The panel is biased towards the channel, to grip the card between the panel and the channel member. The display panel may be curved to match the general curvature of the channel. The clip is comprised of a generally hook-shaped member, when seen in cross-section, that comprises the lower edge of the holder. The clip defines an interior region, within which a lip of the channel member may be snap-fitted. The clip is provided with first and second shoulders protruding into the interior of the clip parallel to the elongate axis of the holder and staggered relative to each other. The shoulders are adapted to grip opposing sides of the channel member, to retain the holder to the channel member and bias the panel towards the channel. The clip is sufficiently resilient to permit a user to bend the panel outwardly from the channel for the insertion of a label or the like between the panel and the channel.

The panel may terminate in an outwardly facing lip, along the edge opposing the clip, to permit the user to retract the panel to insert or replace a label. Preferably, the lip comprises the upper edge of the holder and the clip comprises its lower edge.

The directional references used herein refer to the device when installed on a horizontally-oriented shelf, with the term "forwardly" referring to the direction away from the shelf and "rearwardly" the direction facing the shelf.

DETAILED DESCRIPTION OF THE PREFERRED EMBODIMENTS

Figure 1:
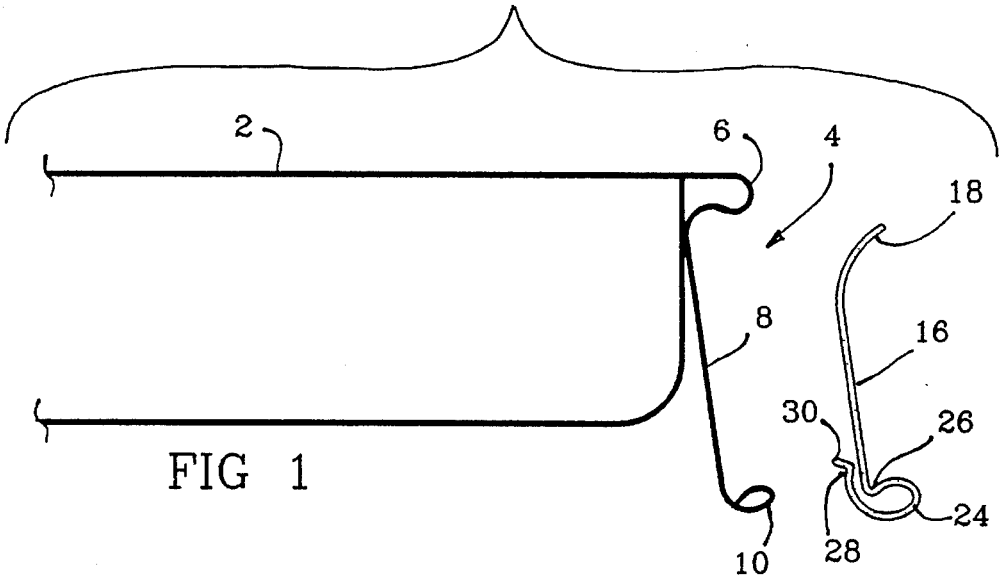
FIG. 1 is a sectional view of a first embodiment of the device and a portion of a metal shelf.
Figure 2:
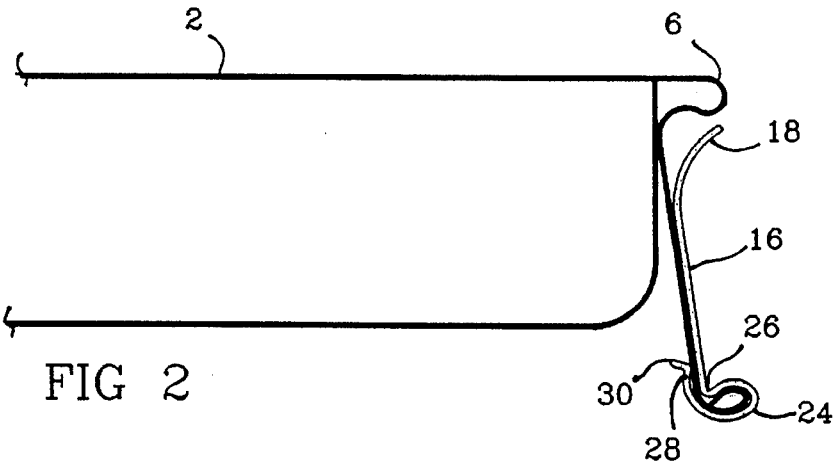
FIG. 2 is a sectional view of the device engaged to a metal shelf.

Referring to FIG. 1, a store shelf 2 is provided with a price ticket channel member 4 along its exposed outer edge. The channel member is comprised of a sheet metal strip, comprising a continuation of the upper surface of the shelf, bent downwardly to form a c-shaped channel. The channel 4 comprises an upper lip 6 that extends forwardly and droops slightly downwardly over a face plate 8, and a lower lip 10 that comprises essentially a mirror image of the upper lip. The face plate 8 is concave when viewed from the front, and typically extends below the lower face of the shelf. A typical shelf has a length of four feet, and the channel extends the length of the shelf.

Figure 3:
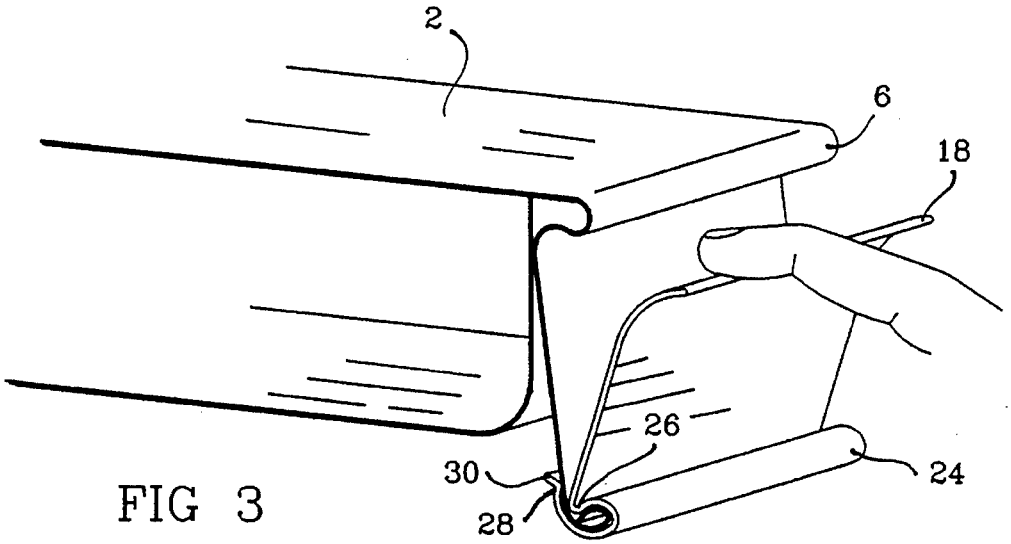
FIG. 3 is a perspective view of a portion of the device engaged to a metal shelf, with the display panel being retracted for insertion of a label.

The channel cover of the present invention comprises a flexible plastic strip adapted to fit over the channel for all or part of its length. The cover is fabricated of an extrusion of semi-rigid plastic that has sufficient transparency to allow easy visibility of the label and the operation of a bar code scanner through the plastic. The body of the cover comprises a clear panel 16 having essentially the same configuration as the face plate of the channel, i.e., generally concave when viewed from the front. The upper edge of the panel terminates in an outwardly-facing lip 18, adapted to allow a user to retract a portion of the cover from the channel, as seen in FIG. 3, to insert or replace display cards.

The lower edge of the panel terminates in a clip 24 integral with the panel. The clip 24 snap-fits over the lower lip of the channel member, and releasably retains the device to the channel member. As well, the clip is provided with spring-bias means to bias the panel 16 towards the face plate 8, to allow the panel to grippingly engage a label between the panel and the face plate. The spring-bias means allow a user to retract the panel sufficiently to position a label behind the panel, but require a measure of force to retract the panel sufficient to discourage unauthorized, casual individuals. The clip 24 comprises a generally hook-shaped member, as seen in cross-section, that defines an interior region having a profile generally similar to that of the lower lip 10 of the channel. The lower lip may be snap-fitted into the interior of the clip. A rearwardly-facing shoulder 26 defines the upper edge of the clip, and is adapted to abut the face plate at the junction of the face plate and the lip 10. The clip 24 has a second, forwardly-facing shoulder 28 adjacent its free edge to grip the rear face of the channel. The shoulders 26 and 28 are staggered, with the second shoulder 28 positioned above the first shoulder 26, to comprise spring-bias means to bias the cover towards the face panel of the channel when the respective shoulders are urged together by the resiliency of the clip. The free edge of the clip terminates in a rearwardly-facing ledge 30, that assists in the engagement of the clip to the lower lip 10.

The design of the clip allows the panel to be retracted without causing the clip to weaken its grip on the lip of the channel.

In use, the holder is installed to the price ticket channel of a shelf by snap-fitting the clip of the holder over the lower lip of the channel. Labels, price tickets, point-of-sale displays, and the like may then be inserted between the holder and the shelf channel by retracting the upper edge of the holder rearwardly, as seen in FIG. 3, inserting the desired material, and releasing. Displays may be retained by the holder that extend above or outwardly from the holder, for example a dangling card holder that is provided with a part insertable behind the holder. The resiliency of the holder requires the user to pull firmly to retract the holder; this ensures both that the display will be firmly held in position by the holder, and makes it more difficult for unauthorized individuals to tamper with the displays. As well, the resiliency of the material allows the holder to grip each label independently of its neighbors, and to retain a label in its place when the panel is retracted for the removal of a neighboring label. The plastic selected for fabrication of the holder must be sufficiently resilient to allow the panel to flex sufficiently to meet these requirements, yet be sufficiently rigid to firmly grip the label and make unauthorized removal difficult.

When it is desired to replace a holder, for example when it becomes damaged, it may be released from the shelf channel by a pulling or twisting motion, and replaced with a new holder.

Figure 4:
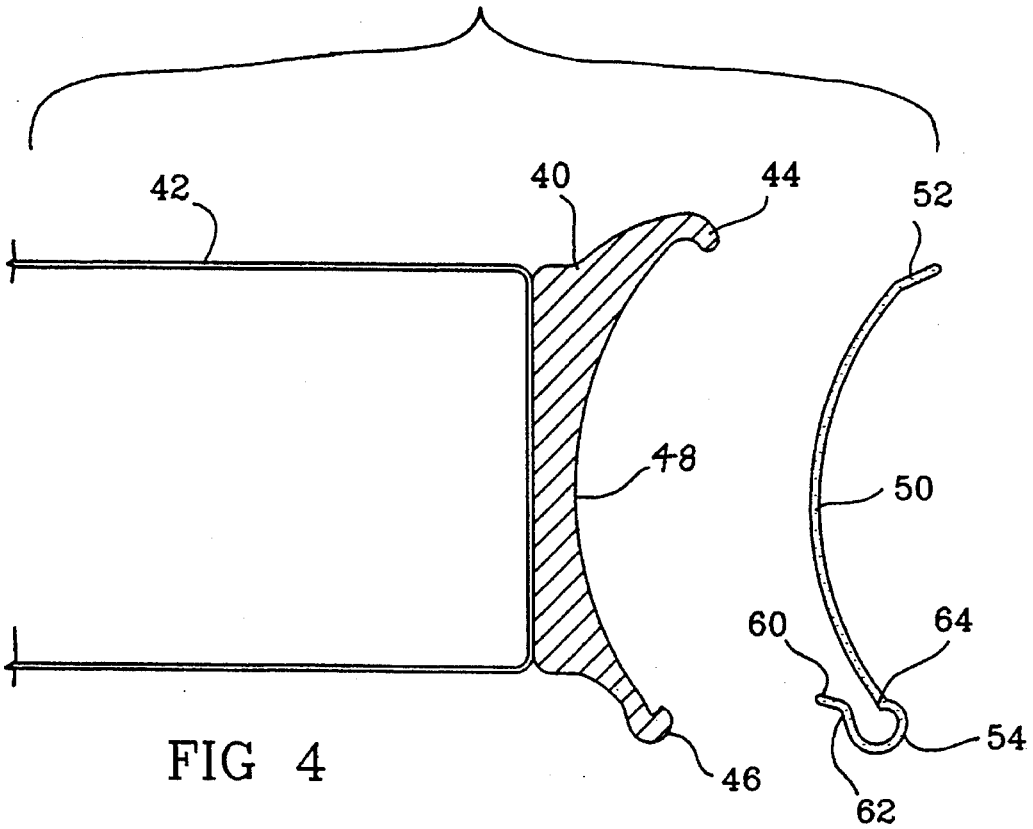
FIG. 4 is a sectional view of a second embodiment of the device and a portion of a metal shelf.
Figure 5:
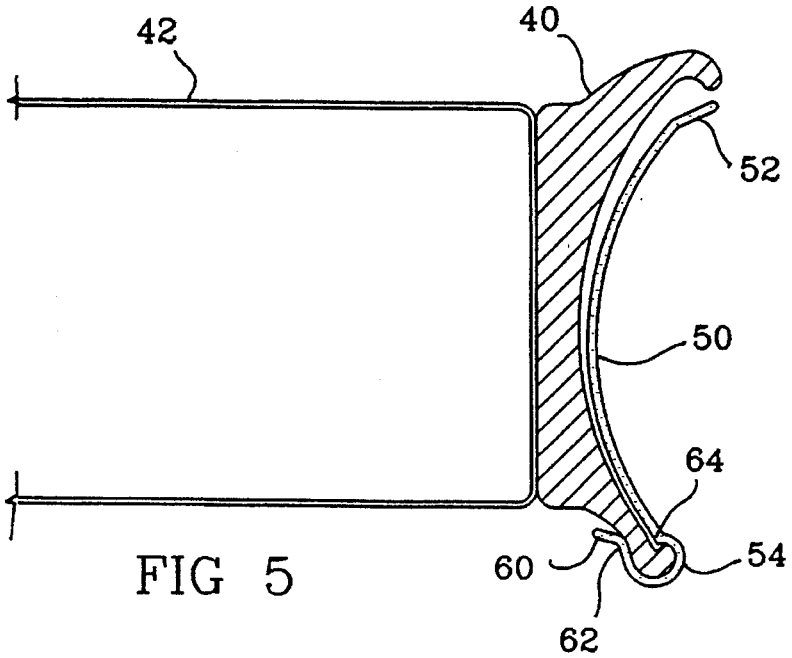
FIG. 5 is a sectional view of the second embodiment of the device engaged to a metal shelf.

A second embodiment of the invention is shown in FIGS. 4 and 5. This embodiment is intended to be installed on a Hussmann-type shelf, having an extruded aluminum channel member 40 bolted or otherwise engaged to the shelf 42. The channel member 40 is similar to that of the sheet metal arrangement described above, and is provided with upper and lower lips 44 and 46, respectively, and a concave face 48. The holder comprises a curved face panel 50, terminating at its upper edge in a lip 52 and at its lower edge in a clip 54. The clip has a similar design to that of the first embodiment, and terminates in a rearwardly-facing lip 60 at its free edge. A forwardly-facing shoulder 62 adjacent the lip 60 engages the clip to the channel lip, and cooperates with a rearwardly-facing shoulder 64 to resiliently bias the holder towards the channel face.

The present invention has been described by way of preferred embodiments thereof. However, it will be apparent to those skilled in the art that variations may be made to the embodiments described herein, without departing from the spirit and scope of the invention, as defined by the appended claims.

I claim:

1. A cover adapted for engagement to a ticket display channel of a metal shelf, said channel having a face plate comprising the floor of said channel and a lip extending outwardly along a longitudinal edge of said channel, said cover comprising an elongate clear panel having an integral clip along a longitudinal edge thereof, said clip comprising a generally hook-shaped member that defines an interior region adapted to grippingly engage said lip, said clip having a spring-bias means to bias said panel towards said face plate when said cover is engaged to said channel to grippingly retain a display card between said panel and said channel, said spring-bias means comprising a pair of opposing shoulders extending into said interior region, said shoulders being staggered relative to each other and adapted to grippingly engage opposing sides of said lip and cooperate with the gripping engagement of said clip to said lip to bias said cover toward said face plate when said clip is engaged to said channel.

2. A cover as claimed in claim 1, wherein a first of said shoulders is adapted to rest at the junction between said lip and said face plate of said channel, when said cover is engaged to said channel.

3. A cover as claimed in claim 1, wherein said panel is provided with an outwardly-curved longitudinal edge opposing said clip and adapted to allow a user to retract a portion of said panel away from said channel to insert a display card between said panel and said channel.

4. A cover as claimed in claim 1, wherein said clip is adapted to be snap-fitted to said lip.

5. A cover as claimed in claim 1, wherein said clip comprises the lower margin of said holder.

* * * * *